US006401927B1

(12) United States Patent
Sorensen et al.

(10) Patent No.: US 6,401,927 B1
(45) Date of Patent: Jun. 11, 2002

(54) POP-UP FOOD TRAY FOR COMBINATION MEALS

(75) Inventors: Bradford T. Sorensen, Glendale, CA (US); Marcia G. Miller, 3464 Meier, Los Angeles, CA (US) 90066

(73) Assignee: Marcia G. Miller, Los Angeles, CA (US)

( * ) Notice: Subject to any disclaimer, the term of this patent is extended or adjusted under 35 U.S.C. 154(b) by 0 days.

(21) Appl. No.: 09/569,909

(22) Filed: May 11, 2000

(51) Int. Cl.[7] ..... B65D 1/34

(52) U.S. Cl. ..... 206/562; 206/565; 206/216; 206/457; 229/904; 273/286

(58) Field of Search ..... 206/562, 563, 206/564, 565, 216, 541, 542, 831, 457; 229/904, 103, 103.1, 200.1, 117.01; 493/162; 273/286, 287, 282.3, 142 K, 142 J, 142 JA, 142 JB

(56) References Cited

U.S. PATENT DOCUMENTS

| | | | | | |
|---|---|---|---|---|---|
| 2,833,458 | A | * | 5/1958 | Toensmeier | 206/562 |
| 2,924,372 | A | * | 2/1960 | Kirkeby | 206/562 |
| 3,001,684 | A | * | 9/1961 | Wenzel | 206/562 |
| 3,324,998 | A | * | 6/1967 | Farquhar | 206/562 |
| 3,434,650 | A | * | 3/1969 | Goings | 206/562 |
| 3,637,130 | A | * | 1/1972 | Farqufar | 206/562 |
| 3,809,310 | A | * | 5/1974 | VanderLugt, Jr. | 229/117.01 |
| 4,472,896 | A | * | 9/1984 | Bruner et al. | 40/312 |
| 4,511,042 | A | * | 4/1985 | Wischusen, III | 206/562 |
| 4,757,937 | A | * | 7/1988 | Maio et al. | 206/562 |
| 5,441,164 | A | | 8/1995 | Beck et al. | |
| 5,497,885 | A | | 3/1996 | Sussman | |
| 5,731,021 | A | * | 3/1998 | Spector | 426/111 |
| 5,915,561 | A | | 6/1999 | Lorenzana et al. | |
| 5,957,276 | A | | 9/1999 | Cutler et al. | |
| 5,964,161 | A | | 10/1999 | Conway | |
| 6,213,389 | B1 | * | 4/2001 | Cai | 229/120.08 |

* cited by examiner

*Primary Examiner*—Shian Luong
(74) *Attorney, Agent, or Firm*—Sheldon & Mak

(57) ABSTRACT

An innovative pop-up food tray for combination meals to function as a lap or seat mounted support for the typical sandwich, drink cup and French fry container related to eating drive-in fast-food while operating an vehicle, which includes the features of a pair of automatic pop-out food tray support legs that position the tray in a passenger seat retained by the seat belt or in the drivers lap, a multiple spring cam mechanism for accommodating a wide variety of drink cup sizes, providing a fold out panel that catches spilled food particles while eating seated in a moving vehicle, a foldable condiment serving tub, a fold out cover that contains the used food containers for convenient disposal, punch out game pieces, a random number spinner wheel and a wide variety of games printed on the tray.

32 Claims, 8 Drawing Sheets

POP-UP FOOD TRAY FOR COMBINATION MEALS

BACKGROUND

This invention relates generally to improvements in food trays which aid in the process of eating food while seated in a vehicle. More specifically, the present invention relates to an innovation in the way drive-up fast-food and its packaging is contained, supported and accommodated to work in cooperation with the human body seated in a moving vehicle to improve the process of consuming the food from the food packaging quickly with a lower chance of accidentally spilling food particles on the vehicle or its human passengers.

Trays for the portable food are well known and in use worldwide. The process of eating food while seated in a moving vehicle involves several common methods today. Today, a typical full meal delivered out the window of a drive-up fast-food restaurant into a vehicle includes a paper bag containing a sandwich and French fries with a separate drink cup commonly referred to as a combination meal or combo meal.

One method is to place the often greasy bag of French fries and hamburger or other sandwich on the passenger seat and place the drink cup in an automotive drink cup holder (if a drink holder is provided in the vehicle). A second method is to place the often greasy bag in the lap with the drink cup held between the knees. A third method is to hold the drink cup in one hand, spread the often greasy sandwich wrapper out on the lap, balance the fries and sandwich between the legs and steer the vehicle with the other hand.

All of these methods have a high risk of spillage of food items with a high risk of soiling clothing or seat fabric with greasy stains and afford minimal accommodation for the forces of vehicular acceleration, deceleration and turning which can cause food items to slide, upset and spill within the vehicle.

The problem of eating in a vehicle in motion while trying to avoid spilling food items within the vehicle simultaneously presents high safety risks to the occupants of the vehicle.

U.S. Pat. No. 5,964,161 to Conway discloses an accordion pleated, boat shaped expandable lap protector tray made of a liquid and grease impervious material to protect the clothing and the interior of a vehicle. The Conway patent defines an expandable, boat shaped lap protector.

U.S. Pat. No. 5,957,276 to Cutler discloses a flat paperboard blank that can be folded into a dual configuration food and beverage container carrier tray with handle flaps that may be folded in two ways to produce two functions.

U.S. Pat. No. 5,915,561 to Lorenzanna discloses an injection molded plastic tray with an elongated body section and recessed areas for food and beverage containers having permanently fixed, downwardly projecting legs to retain the tray positioned and engaging the outer thighs of a seated vehicle occupant.

U.S. Pat. No. 5,497,855 to Sussman discloses a molded fiber paper lap tray having permanently fixed downwardly projecting legs, tapered drink cup holder, a pair of food containers and an annular rim to prevent food spillage while riding in a vehicle.

U.S. Pat. No. 5,441,164 to Beck discloses an injection molded plastic car lap tray forming a combination food and beverage plate with a substantially concentric circle design having a drink cup cylinder in the center of a larger circular food support plate.

Unfortunately, the devices of the prior art exhibit a number of disadvantages. For example:

1. They are ineffective in securely holding drink cups, particularly when the cups come in multiple sizes;
2. They are excessively bulky for convenient storage;
3. They will not stay in place when placed in a user's lap;
4. They are ineffective in preventing food spillage onto a user's clothing;
5. They are ineffective in holding fluidic condiments separately from other food items; and They are expensive to provide.

Thus there is a need for a tray for holding potentially messy objects such as fast food items to be consumed by a seated user that overcomes the disadvantages of the prior art.

SUMMARY

The present invention meets this need by providing a pop-up tray that is particularly suitable for holding fast food items to be eaten by vehicle occupants.

The invention involves an improvement in the way food items are consumed within a moving vehicle. The improvement relates to a change in the utility of food packaging which offers reduced risk of spillage caused by the motion of the vehicle, providing a safe place to position food items during both hand operation of vehicular controls, improved protection from food items soiling clothing or seat fabric and an accommodation for the collection, deposit and enclosure of refuse for disposal. The present invention improves the utility of such trays with the innovations of a multiple spring cam mechanism for accommodating a wide variety of drink cup sizes, providing a fold-out panel that catches spilled food particles while eating seated in a moving vehicle, a foldable condiment serving tub, a fold-out panel that contains the used food containers for convenient disposal and automatic pop-out food tray support legs that positions the tray in the driver's lap or in a passenger seat.

The tray has an automatic pop-out food tray support leg system that position the tray in the drivers lap or in a passenger seat. By simply pushing on the ends of the flattened tray, leg extremities are pivoted downwardly and outwardly, and other panels are put into motion with a variety of pivots, arches, cam actions and over center locks that cause the tray to erect itself into a 3-dimensional structure that automatically extends a pair of support legs, creates a hollow open space inside the tray, arches the top surface of the tray to add rigidity to the structure and creates a bridge structure with legs on two ends with the tray elevated and supported on the legs.

In one aspect of the invention, a pop-up tray includes a tubular structure including top, bottom, front and back wall portions having hinged connections therebetween, and a pair of leg walls having hinged connections to the tubular structure at opposite ends thereof, the tray having a storage condition wherein the top and bottom wall portions are in facing contact and the front and back wall portions and the side walls are disposed parallel to the top and bottom walls, and a deployed condition wherein the top and bottom walls are stiffly spaced apart and the leg walls stiffly project below the bottom wall portion, the top wall having openings formed therein for receiving objects to be held by the tray.

The front and back wall portions can each have hingedly connected upper and lower sections, the upper and lower sections having facing contact in the storage condition. The leg walls can each have hingedly connected upper and lower segments, the lower segment being hingedly connected at an intermediate location to the bottom wall portion, the upper and lower segments having facing contact in the storage condition. The upper section of each of the leg walls can be hingedly connected along a leg hinge axis to the top wall portion, the leg hinge axes having respective non-linear shapes with internal stresses in at least some of the panels for detenting the tray into the deployed condition. The leg hinge axes can be curved, being preferably concave outwardly along opposite ends of the top wall portion for forming the top wall portion upwardly convex in the deployed condition of the tray.

In another aspect of the invention, a method for serving fast food items for consumption thereof includes:

(a) providing the pop-up tray of the present invention in the storage condition thereof;

(b) applying downward and oppositely outward forces to free end extremities of the leg walls while simultaneously applying opposite inward forces to upper portions of the leg walls, thereby popping the tray into the deployed condition; and (c) inserting the fast food items into respective ones of the top wall openings.

The lower segments of the leg walls can be reinforced for limiting bending thereof.

In one preferred form, a generally rectilinear tray formed of paper, plastic or other sheets of material pops-up from a flattened storage condition to provide a food serving tray that functions as a lap or seat mounted support for the typical sandwich, drink cup and French fry container related to eating drive-in fast-food while operating an vehicle. A multiple spring cam mechanism can accommodate a wide variety of drink cup sizes by bending and conforming the tray material to the conical contours of a typical drink cup to form a double ring of multiple contact points with the cup, which tends to secure the base of the cup on two levels providing a stable yet flexible cup holder, which exposes the upper portion of the cup to be available for grasping and easy removal for use, then, after use, easy replacement for hands-free support of the cup.

Preferably the spring cam elements are coplanar with the top wall portion in the storage condition, the cam elements being formed for contacting the beverage cup at a first plurality of locations proximate the base thereof, and at a second plurality of locations being elevated above the first plurality of locations, with the cup resting on the bottom wall portion. Preferably The spring cam elements are integrally formed with the top wall portion for facilitating manufacture and storage. Preferably the spring cam elements are formed for making gripping contact over a range of cup diameters at the respective contact locations being in a ratio of 2 to 1.

The openings of the top wall can include a main opening for receiving a main object, the tubular structure further comprising a plurality of container wall portions hingedly connected to top wall portion and extending within the main opening, free extremities of the container wall portions being formed for interlocking engagement between the top wall portion and the bottom wall portion when the tray is in the deployed condition. The top wall portion can be upwardly convex in the deployed condition of the tray, the container wall portions including a pair of longitudinally spaced side wall portions, the side wall portions being hingedly joined to the top wall portion along corresponding side hinge axes, the side hinge axes being curved inwardly concave for reinforcing the upwardly convex formation of the top wall portion and the interlocking engagement of the container wall portions.

The tray preferably provides a fold out panel that catches spilled food particles while eating seated in a moving vehicle. The fold-out panel has three operating positions, first, the fold-out panel has a compact conformal wrap position that stays out of the way during transfer from the restaurant to the vehicle, second, the fold-out panel pivots out to an angle that rests on the users chest and belly when the tray is in the lap so that the panel can shield the user's clothing from particles of food spilled while eating in a moving vehicle, and third, the fold-out panel folds to enclose the empty French fry container, empty drink cup and other empty packaging for transport to a garbage can for disposal. The tray is preferably formed for covering a main dish opening (such as for retaining heat) without blocking the placement of projecting items such as the drink cup or French fry container in other openings.

The tray can also include an innovative a foldable condiment serving tub that is formed from the sheet of material removed to create space for the French fry container retention hole. This material is removed, folded and inserted into a receptacle hole in the tray to form a container for condiments.

A free extremity of the tray panel can be formed for tab-engagement with the top wall portion for holding the tray panel in the closed position. The tray panel can have a main portion and a root portion hingedly connecting the main portion to the tubular structure proximate an upper extremity of the front wall portion, the main and root portions being hingedly connected, the root portion being in facing contact with the front wall portion in the storage position.

The tubular structure, the leg walls, and the tray panel can be integrally formed of a single sheet of card stock, substantially every wall portion and every wall segment being subjected to one or more of bending, twisting, arching, stretching and compressing in the deployed condition for enhanced rigidity of the tray in use. The leg walls can be perforated for forming finger openings by removal of portions of the card stock, portions of the card stock to be removed having indicia thereon for forming game tokens, the top wall portion having token openings for holding the game tokens, the tray panel having indicia thereon for defining a game playing surface.

In a further aspect of the invention, the pop-up tray includes the tubular structure having top, bottom, front and back wall portions having hinged connections therebetween, and a pair of end walls having hinged connections to the tubular structure at opposite ends thereof, the tray having a storage condition wherein the top and bottom wall portions are in facing contact and the front and back wall portions and the side walls are disposed parallel to the top and bottom walls, and a deployed condition wherein the top and bottom walls are stiffly spaced apart, the top wall being stiffly maintained in a curved condition in the deployed condition and having at least one opening formed therein for receiving an object to be held by the tray.

The end walls can each have hingedly connected upper and lower segments, the lower segment being hingedly connected at an intermediate location to the bottom wall portion, the upper and lower segments having facing contact in the storage condition. The upper section of each of the end walls is hingedly connected along an end hinge axis to the top wall portion, the end hinge axes having respective non-linear shapes for detenting the tray into the deployed condition. The end hinge axes can be curved, being concave outwardly along opposite ends of the top wall portion for forming the top wall portion upwardly convex in the deployed condition of the tray.

In yet a further aspect of the invention, a method for forming a pop-up tray includes:

(a) providing a sheet of stiffly flexible material;

(b) forming a perimeter contour of the sheet to define adjacent top, bottom, front and back wall portions, and a tab wall portion, of a tubular structure, the front and back wall portions each having upper and lower wall portion segments; respective outer leg wall portions adjacent opposite ends of the top wall portion; and respective inner leg wall portions adjacent opposite ends of the bottom wall portion, each of the inner and outer leg wall portions having upper and extremity segments, the extremity segments being longer than the upper segments;

(c) forming hinge discontinuities between adjacent pairs of the wall portions, along opposite ends of the top and bottom wall portions, between the upper and lower wall portion segments, and between the upper and extremity leg wall segments;

(d) forming at least one opening in the top wall portion;

(e) bonding the tab wall portion to another of the wall portions along a most remote opposite wall portion extremity of the sheet to form the tubular structure;

(f) flattening the tubular structure with the upper and lower wall portion segments in facing relation and the top and bottom wall portions in proximal facing relation;

(g) folding the inside leg wall portions between the upper and extremity segments thereof into facing relation with the extremity segments facing the bottom wall portion opposite the top wall portion;

(h) folding the outside leg wall portions between the upper and extremity segments thereof into facing relation with the extremity segments facing corresponding extremity segments of the inside leg wall portions; and (i) bonding respective ones of the inner and outer leg wall portion extremity segments in facing relation, thereby completing the tray in the flattened storage condition with the top and bottom wall portions in proximal facing contact, the deployed condition being attained by subsequently pivoting the leg wall extremity segments downwardly and outwardly to rigidly space apart the top and bottom wall portions as the upper segments of the leg walls pivot downwardly and inwardly relative to the top wall portion into an over-center condition relative to the extremity segments.

Forming the perimeter contour can further include defining a tray panel portion adjacent the front wall portion, the forming of hinge discontinuities further includes a longitudinal discontinuity between the tray panel portion and the front wall portion, and the bonding of the tab wall portion is to the front wall portion proximate the tray panel, the method further including folding the tray panel portion into proximal facing relation with the front and bottom wall portions. Forming the perimeter contour can further include defining respective outwardly concave leg hinge axes between the upper segments of the outer leg walls and the top wall portion whereby the top wall portion is upwardly convex in the deployed condition.

The tray also provides a practical, inexpensive, easy to ship, easy to print, easy to manufacture, compact to store, convenient, popular, new form of advertising for fast food restaurants that increases consumer loyalty.

The present invention strives to make this process less risky by organizing the food items into a multifunction tray consisting of a pop-up food serving tray to function as a lap or seat mounted support for the typical sandwich, drink cup and French fry container related to eating drive-in fast-food while operating an vehicle, which includes the features of a multiple spring cam mechanism for accommodating a wide variety of drink cup sizes, providing a fold out panel that catches spilled food particles while eating seated in a moving vehicle, a foldable condiment serving tub, a fold out cover that contains the used food containers for convenient disposal and automatic pop-out food tray support legs that position the tray in the drivers lap or in a passenger seat.

DRAWINGS

These and other features, aspects, and advantages of the present invention will become better understood with reference to the following description, appended claims, and accompanying drawings, where:

DESCRIPTION

Figure 1:
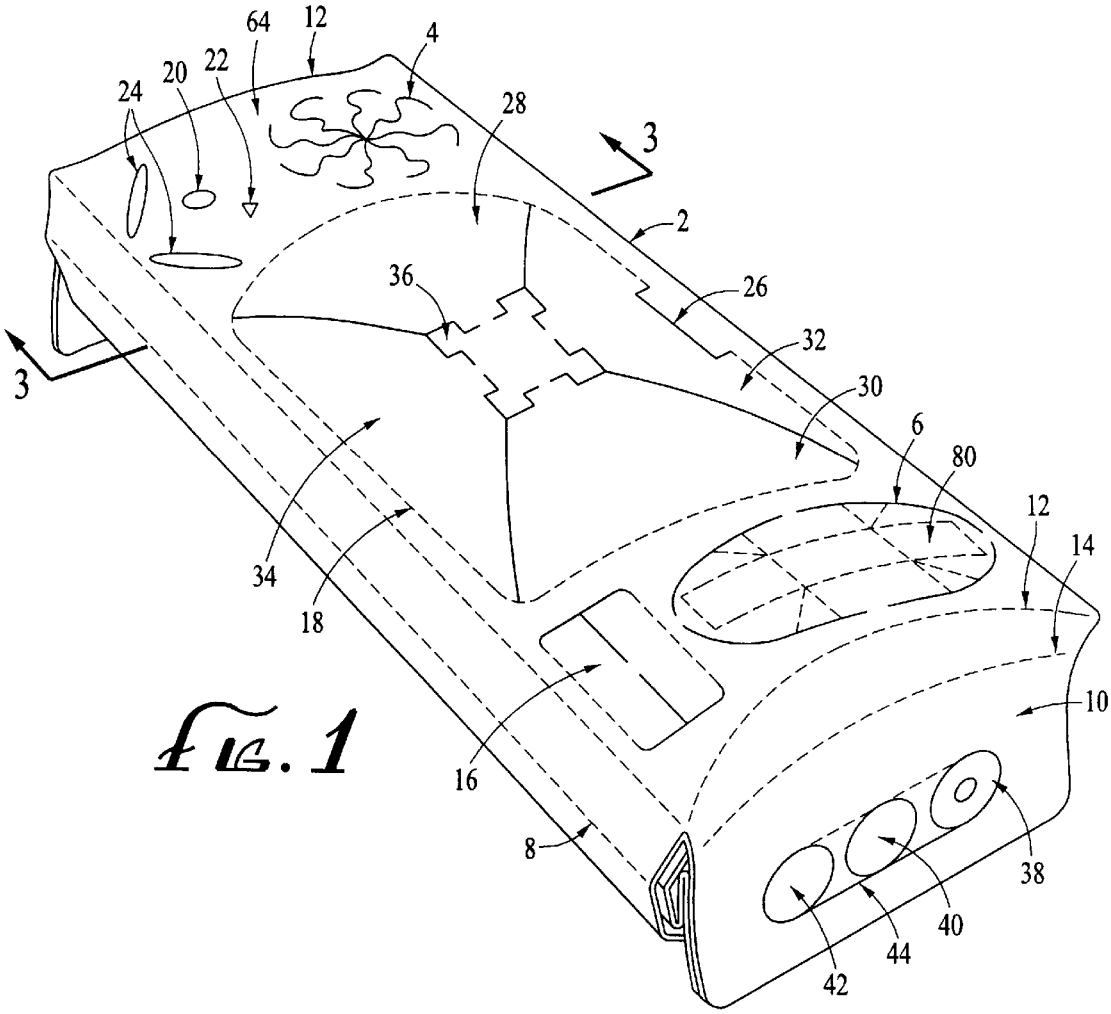
FIG. 1 is a perspective view showing one embodiment of a pop-up tray according to the present invention, for organizing and supporting of food items referred to as a combo meal.
Figure 2:
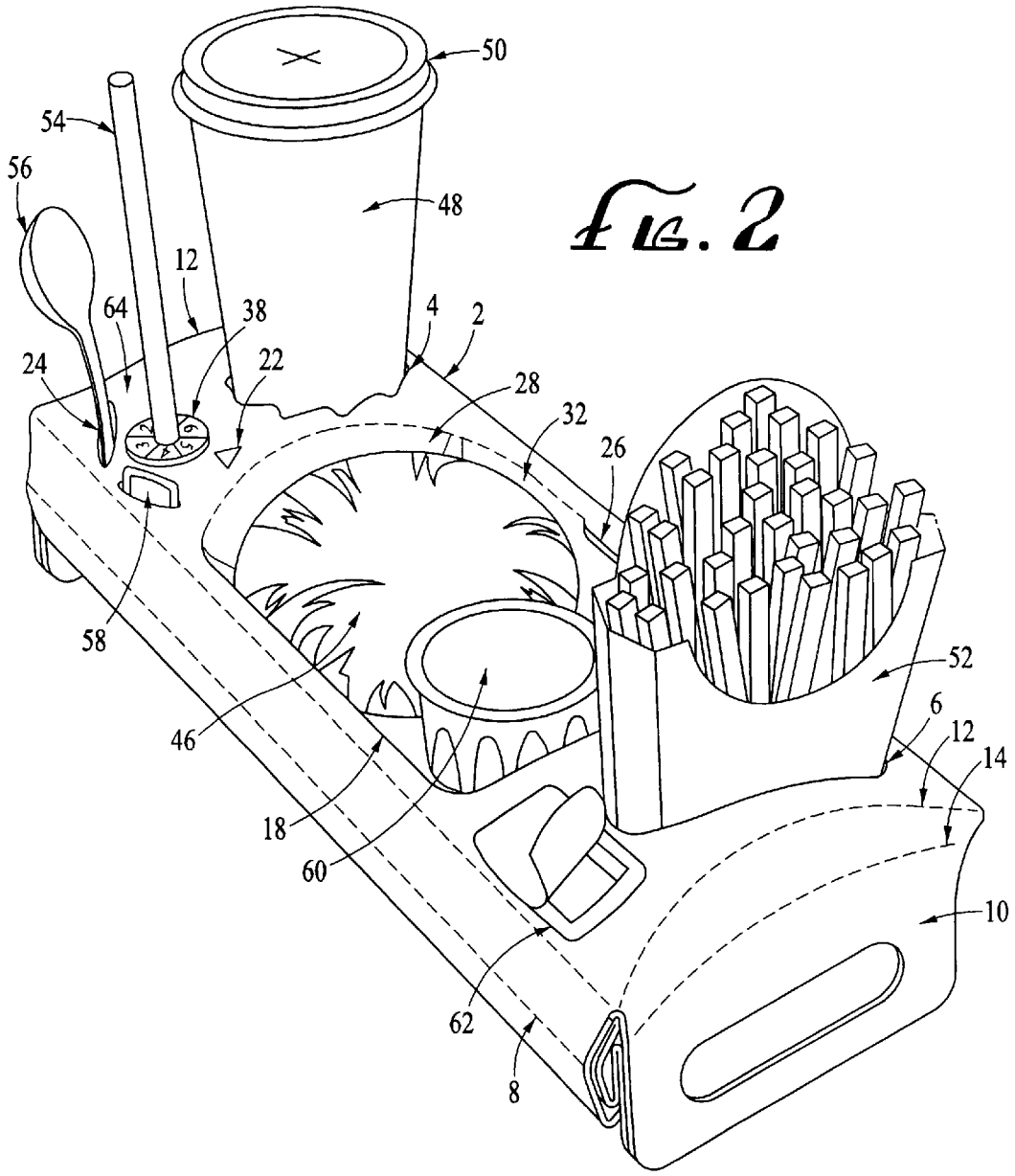
FIG. 2 is a perspective view as in FIG. 1, showing insertion of a drink cup, a French fry container, condiment container, dessert container, spoon, straw, napkin and a typical sandwich into the tray.
Figure 3:
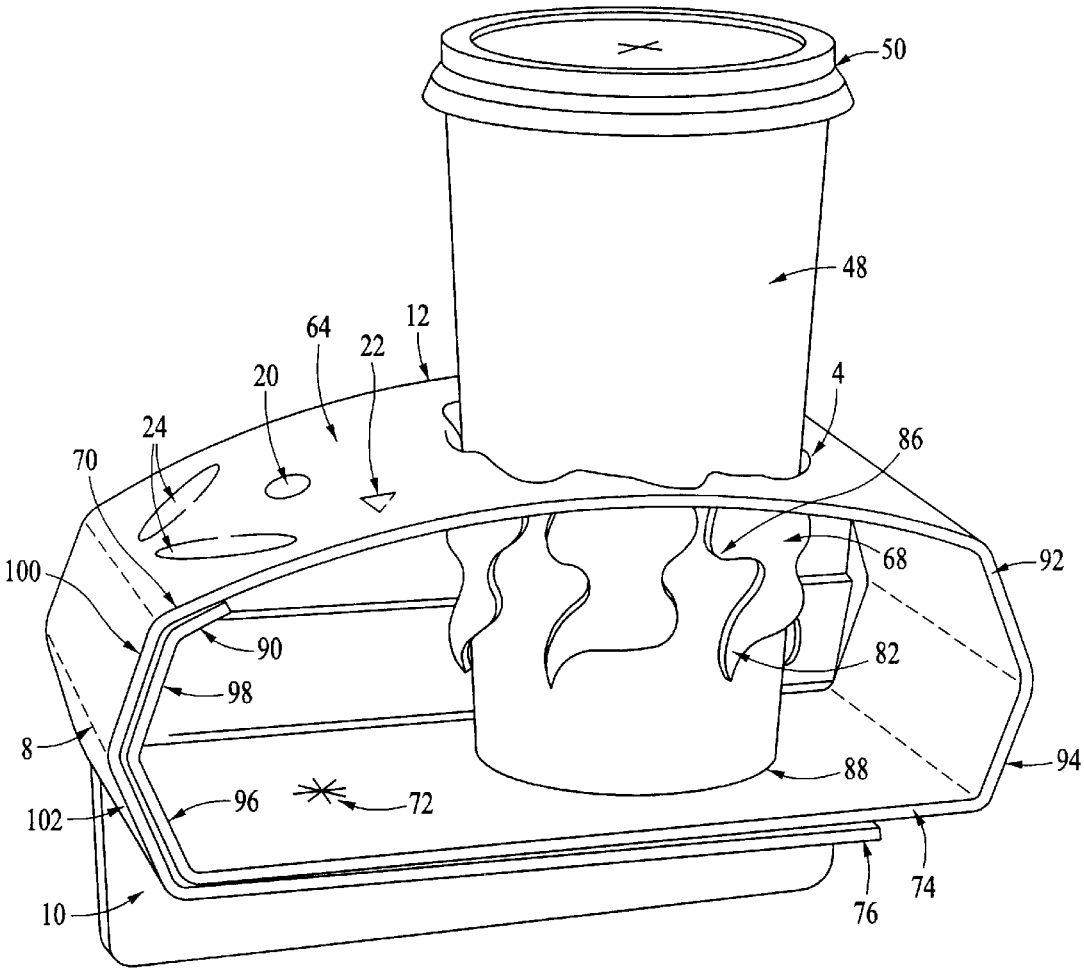
FIG. 3 is a sectional perspective view on line A—A in FIG. 1 illustrating a multi cam action drink cup holder engaging a typical drink cup at multiple heights and at multiple radial locations providing a secure friction fit with several different sizes and tapers of drink cups.
Figure 4:
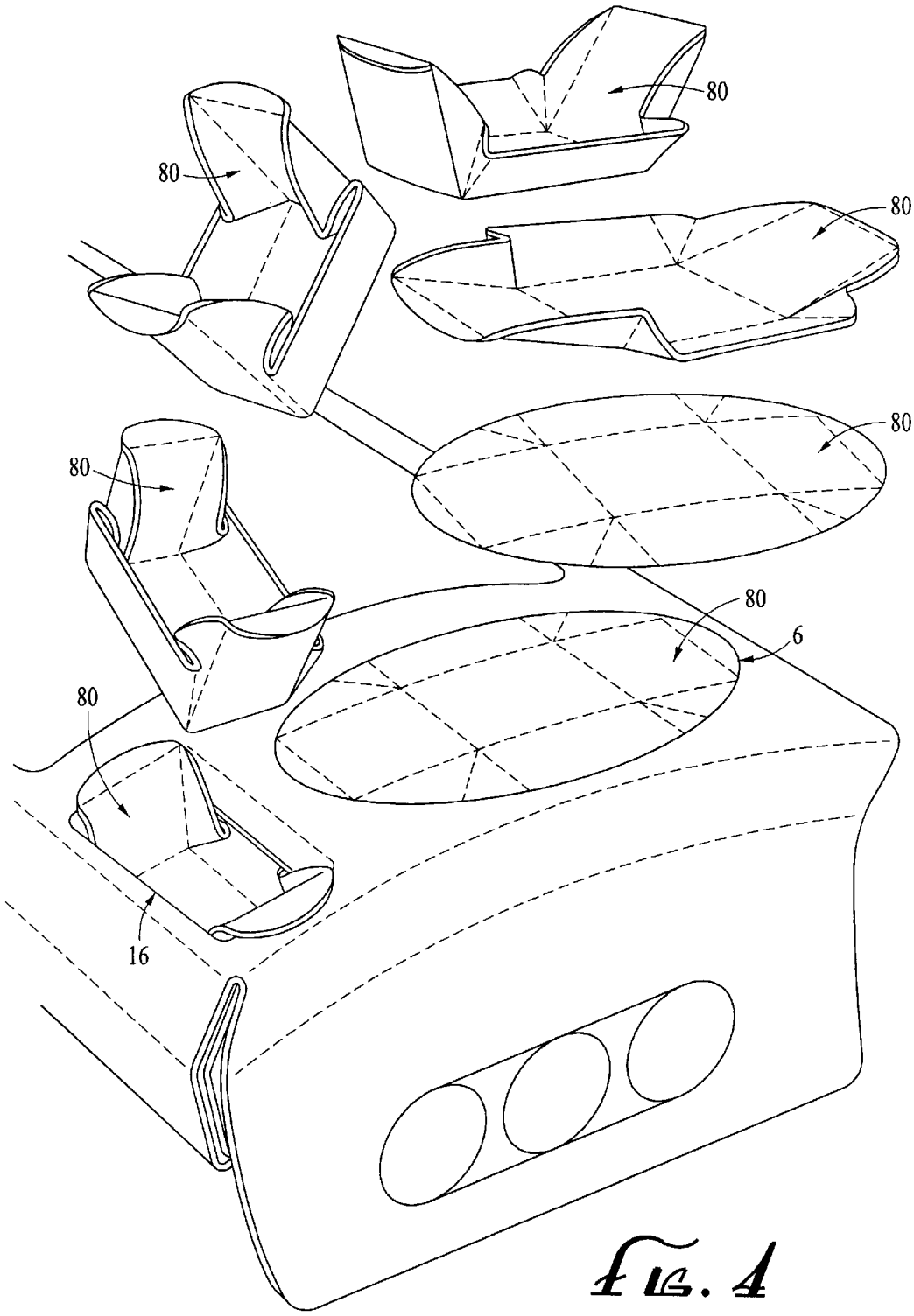
FIG. 4 is a perspective view showing a portion of the tray of FIG. 1 having a foldable condiment serving tub as it is created by removing the oval blank of sheet material from the French fry hole and folding along the provided perforations to create a container that slips into a condiment tub receiving trap door provided in the top surface of the tray.

The present invention is directed to a pop-up tray that is particularly effective for holding fast food items to be eaten by vehicle occupants. With reference to FIGS. 1–14 of the drawings, there is shown in FIG. 1 one embodiment of the present invention illustrating the unique shape of the tray which functions in cooperation with the lap and the other parts of the human body to provide a food packaging support action while minimizing spillage. FIG. 2 shows the insertion of a typical drink cup, a French fry container, condiment container, spoon, straw, napkin and a typical sandwich into the accommodations provided by the current invention. FIG. 3 illustrates the function of the multi cam action drink cup holder engaging a typical drink cup in multiple places at multiple levels of contact which provides a secure yet size tolerant slip fit accommodation for easy entry and removal of the cup for drinking purposes. FIG. 4 shows a foldable condiment serving tub which is created using the punched out center section of the French fry as the material to make up the tub. The substantially flat punched out center blank section is folded in multiple planes and angles to form a container for viscous or liquid material such as Catsup, Mustard, Barbecue Sauce or other condiment in a form that makes dipping French fries or other food into the condiment convenient and accessible.

Figure 5:
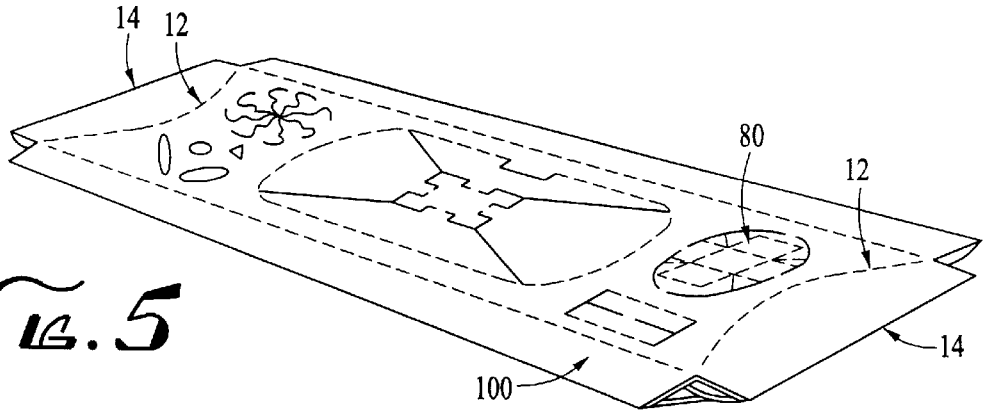
FIGS. 5–7 are perspective views of the tray of FIG. 1 showing progressive deployment of automatic pop-out food legs that position the tray in the lap of a seated occupant of a vehicle.
Figure 6:
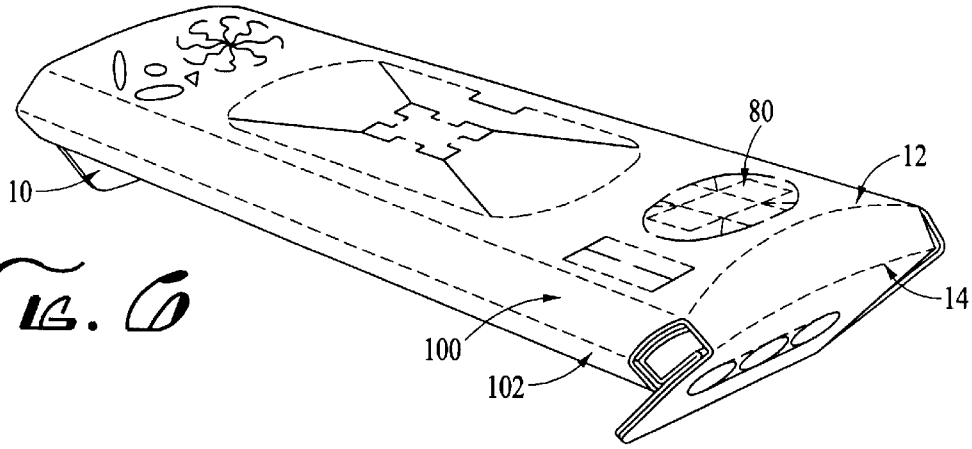
Figure 7:
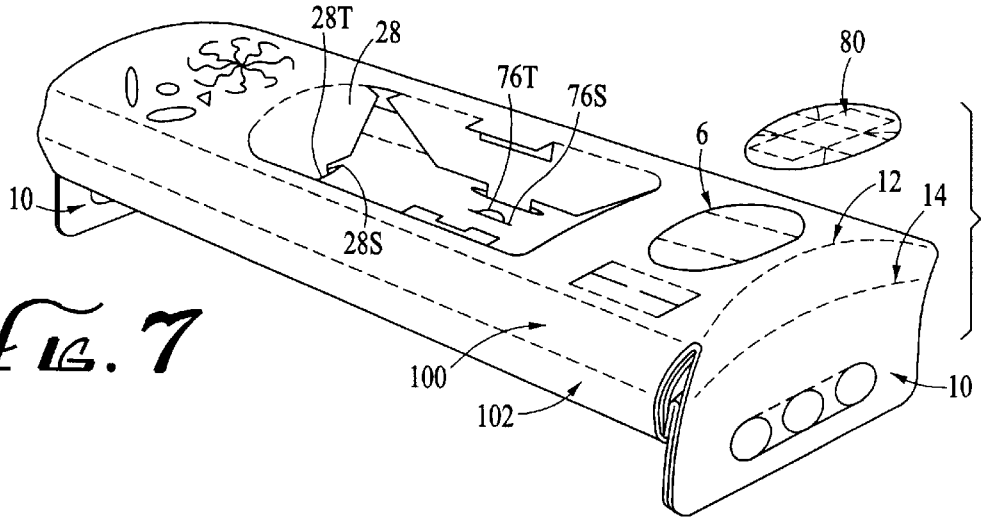
Figure 8:
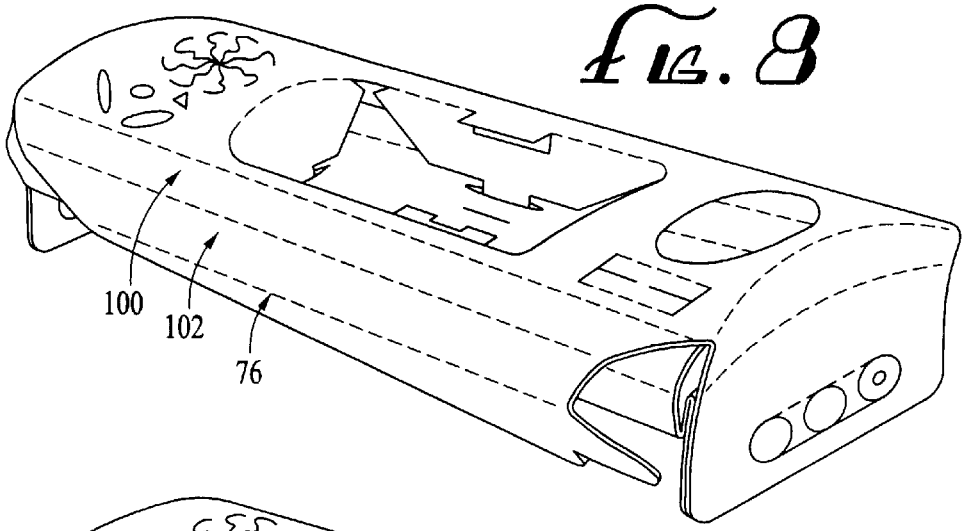
FIGS. 8–10 are perspective views of the tray of FIG. 1 showing a fold out panel being deployed for catching spilled food particles.
Figure 9:
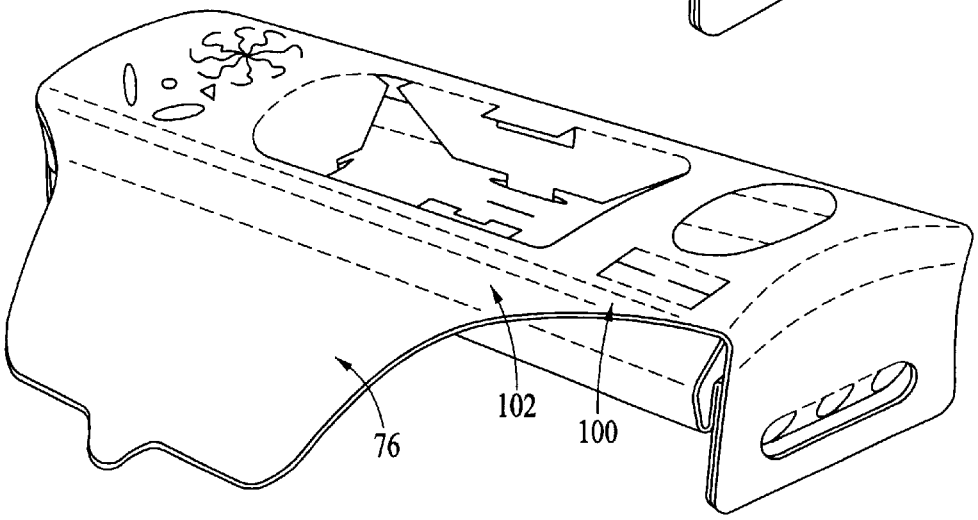
Figure 10:
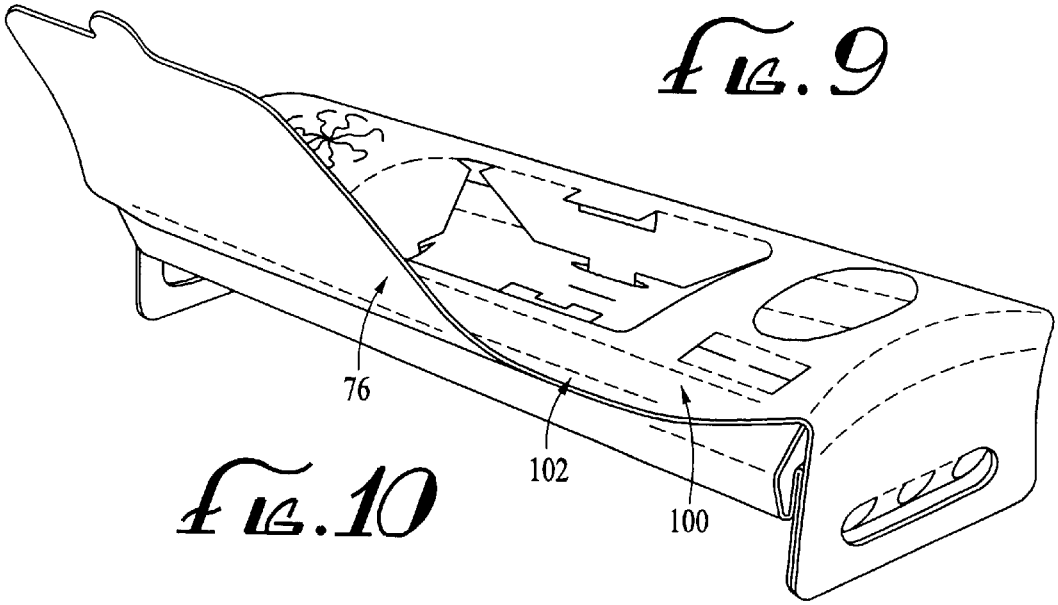
Figure 11:
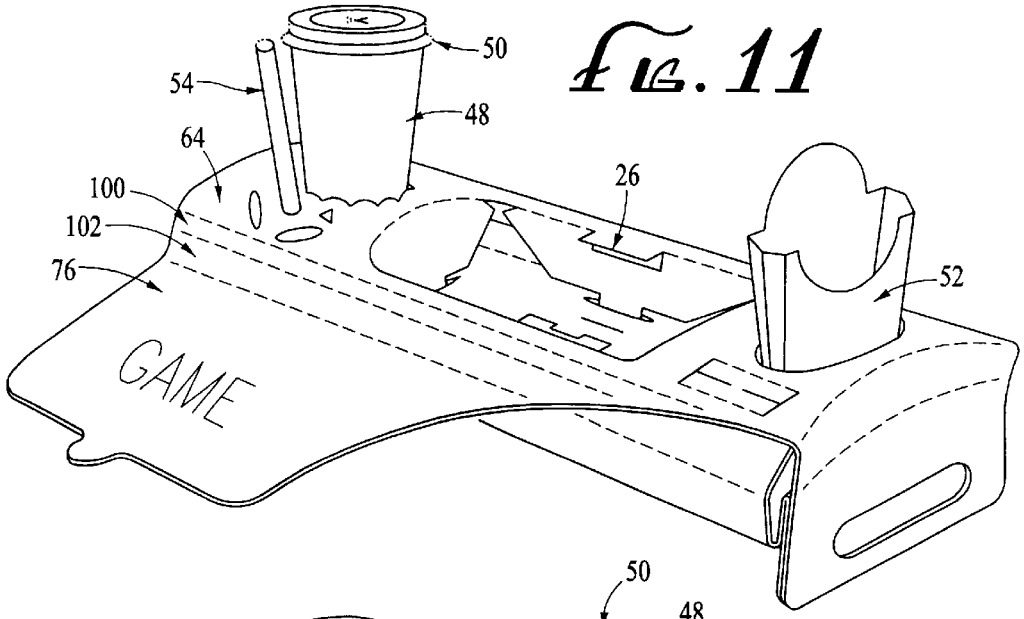
FIGS. 11–13 are perspective views of the tray of FIG. 1 showing the fold out panel being closed to cover the used food containers for convenient disposal.
Figure 12:
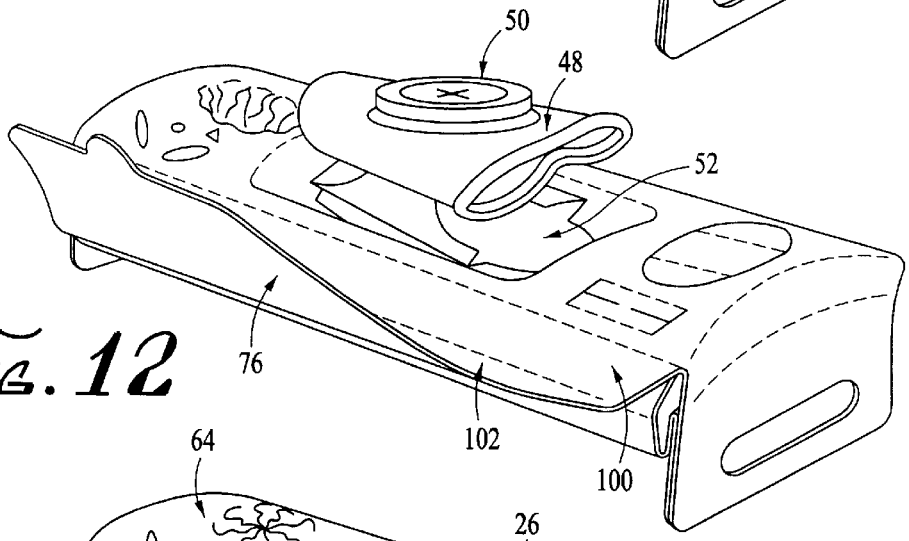
Figure 13:
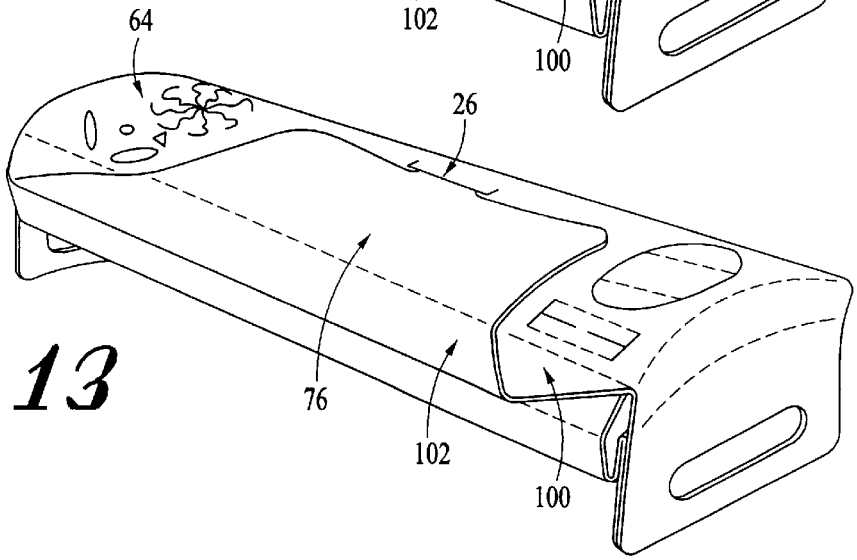
Figure 14:
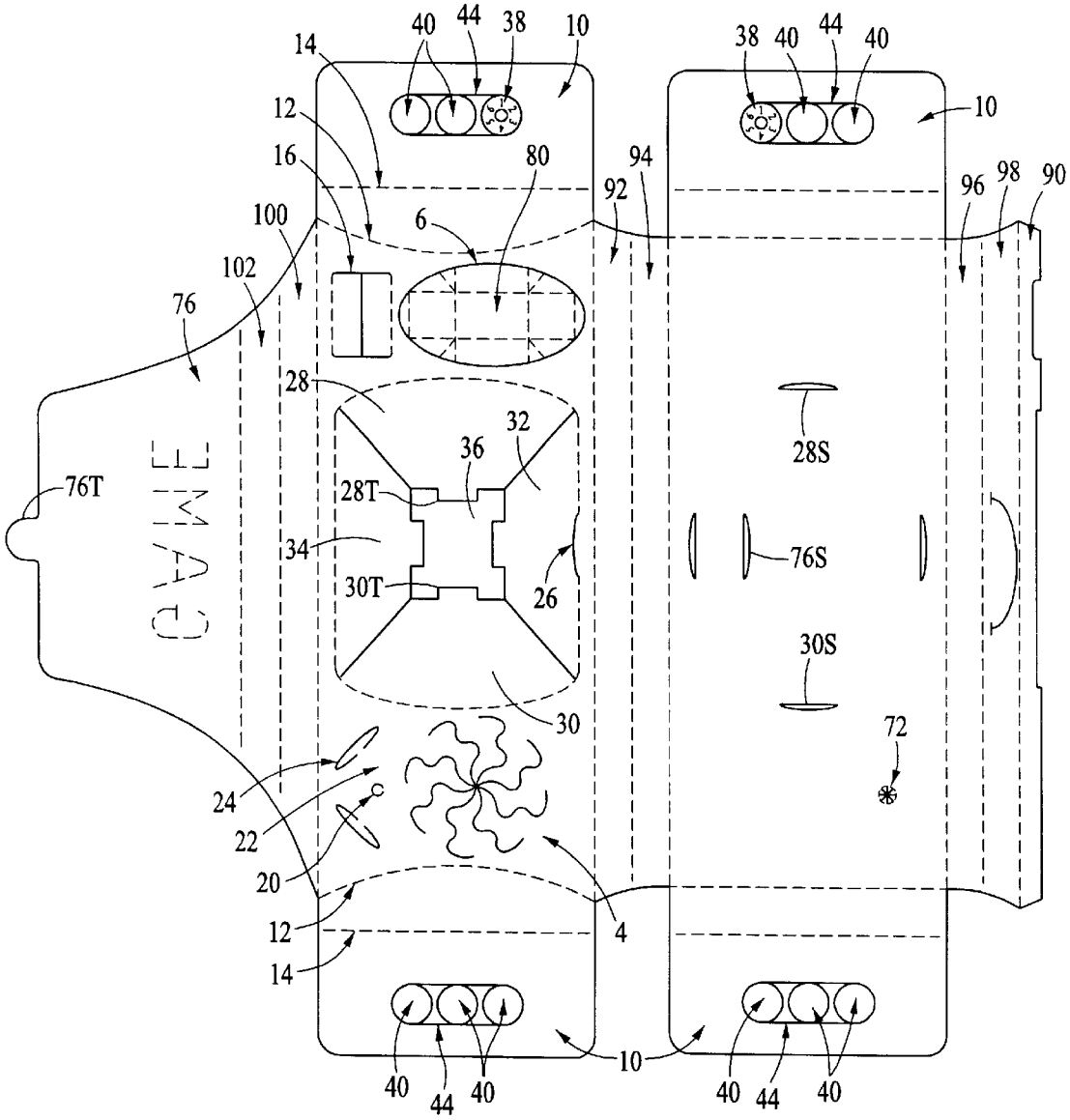
FIG. 14 is a flat pattern layout for the pop-up tray of FIG. 1 including integral formation of the fold out panel.

FIG. 5 illustrates the tray in a compact, folded down configuration, typical of the condition this embodiment of the invention is in while being shipped to the restaurant in stacks of trays. FIG. 6 illustrates the automatic pop-out food tray support legs being deployed as the box structure expands, curves and erects into a functional position. FIG. 7 shows the fully erected, functional position of the tray with the legs in the fully down and locked position to provide an elevated platform for the food on a table or a support that fits into a typical car seat for support of the meal while eating in a moving vehicle. FIGS. 8, 9 and 10 illustrates the fold out panel that catches spilled food particles while eating seated in a moving vehicle, being folded out from its stored position under the tray. FIGS. 11, 12 and 13 shows the fold out panel that also functions as a fold over cover that contains the used sandwich wrapping paper, crushed drink cup, cup lid, folded French fry container, crushed dessert container, straw, used condiment packs, used utensils and used napkins in a neat, organized package for convenient disposal. FIG. 14 shows one embodiment of the current invention in the form of a die cut pattern for the food tray showing the multiple spring cam mechanism for accommodating a wide variety of drink cup sizes the fold out panel that catches spilled food particles while eating seated in a moving vehicle, the foldable condiment serving tub, the fold out cover that contains the used food containers for convenient disposal, the punch out game pieces, the random number spinner wheel and automatic pop-out food tray support legs.

More particularly, a pop-up tray 2 for combination meals as shown in FIG. 1 includes a multiple spring cam mechanism 4 for accommodating a wide variety of drink cup sizes, a French fry container retention hole 6 containing a flat condition foldable condiment serving tub 80 that is formed from the sheet of material removed to create space for the French fry container retention hole 6 with a pair of multifunction automatic pop-out food tray support legs 10 shown in the full down and locked position caused by the effect of the curved score over center cam mechanism 12 and the locking over center cam hinge 14 that snap the legs 10 into a secure down and locked position when pushed inward by simple finger pressure. A multifunction condiment trap door 16 provides the functions of supporting typical form-fill&seal peelable tubs 62 of barbecue sauce or other condiment as well as providing a perimeter support and containment walls for the foldable condiment serving tub 80 to bayonet mount within to form a stable condiment dipping station as shown in FIG. 4. The pop-up tray 2 for combination meals has a multifunction large food item containment zone 18 consisting of a left curved score over center cam stiffener and food item containing hinge mechanism 28, a right curved score over center cam stiffener and food item containing hinge mechanism 30. When the hinge mechanisms 28 and 30 are pushed down into the box, the curved score bends which automatically arches the top surface 64 of the pop-up tray 2 causing a tension and stiffening effect on both the top and bending surfaces until the tab 28T snaps into the slot 28S on the bottom surface 74 of the pop-up tray 2 as shown in FIG. 7, causing an over center cam lock function providing an additional stiffening function and forming vertical support walls to contain food items in place during the cornering forces related to a vehicle in motion. The multifunction large food item containment zone 18 also includes the front straight score over center cam stiffener hinge 32 and the rear straight score over center cam stiffener hinge 34 that when bent down and the tab 30T snapped into a slot 30S in the bottom surface 74 of the pop-up tray 2 causing an over center cam lock function providing an additional stiffening function and forming vertical support walls to contain food items in place during the accelerating and decelerating forces related to a vehicle in motion.

When the front stiffener hinge 32 is folded down, an overlapping die cut automatically forms a tab retention slot 26 to facilitate the refuse containment function. When the rear stiffener hinge 34 is folded down, the proof of purchase tab 36 is hinged to swing away from the tab to rest on the bottom surface 74 of the pop-up tray 2 to remain available for removal and collection for redemption of prizes for certain numbers of proof of purchase tabs 36 during a certain time period. Another function of the pop-up tray 2 for combination meals invention is entertainment. The numbered random spinning device 38 and the game pieces 40 and 42 are cut from the waste sheet material 44 that is pushed aside to create lifting handles in the multifunction automatic pop-out food tray support legs 10. The numbered random spinning device 38 is actually made up of two thicknesses of the sheet material which are glued together with printed sides on both the top and the bottom of the numbered random spinning device 38 because of the folding and gluing operations necessary to assemble such a tray. As a result, the numbered random spinning device 38 and the game pieces 40 and 42 are printed on both sides for application of radial numbers on the numbered random spinning device 38 and the printing of icons, characters, cartoons or other images on the game pieces 40 and 42.

FIG. 2 shows the present pop-up tray 2 for combination meals with the typical components of a combination meal inserted into the appropriate locations in the invention. A typical drink cup 48 with a drink lid 50 is inserted into the multiple spring cam mechanism 4 for accommodating a wide variety of drink cup sizes where it encounters a double ring of multiple contact points with the cup which provides a stable yet flexible cup holder. A typical French fry container 52 is shown inserted into the French fry container retention hole 6. A typical sandwich 46 and a typical dessert 60 container are shown inserted into the multifunction large food item containment zone 18. A drinking straw 54 is inserted through the drinking 20 straw hole through the box to the straw retention cam 72 to hold the drinking straw 54 in a substantially vertical position for use as a pivoting axle for the numbered random spinning device 38 to freely rotate about until friction causes the numbered random spinning device 38 to stop rotating adjacent to the die cut indicator arrow 22 which points to the printed number on the numbered random spinning device 38 to indicate the number of spaces to advance in a printed board game provided elsewhere on the surfaces of the invention. A typical eating utensil 56 and a typical condiment packet 58 are shown inserted into the organizer slots 24 provided in the top surface 64 of the pop-up tray 2 for combination meals invention. A typical form-fill&seal peelable tub 62 of barbecue sauce or other condiment is illustrated inserted into the multifunction condiment trap door 16 provided in the top surface 64 of the pop-up tray 2 for combination meals invention.

As shown in FIG. 3, the function of the multiple spring cam mechanism 4 accommodates a wide variety of drink cup sizes having a range of at least 2 to 1 where the conical shape of a typical drink cup 48 passes through the multiple spring cam mechanism 4 which deforms and creates spring tension against the cup as it encounters a double ring of multiple contact points including an lower ring of contact points 82 and a upper ring of contact points 86 which provides a stable yet flexible supportive connection with the conical shape and variety of sizes of cups offered with the beverages related to combination meals available at most fast food restaurants. The bottom rim of the drinking cup 88 comes in contact with the bottom surface 74 of the pop-up tray 2 in order to provide more cup support during the motions of the vehicle. As further shown in FIG. 3, the longitudinal glue application zone 70 attaches the top surface panel 64 to the glue tab 90 to form a connection between the top surface 64, the rear top hinge plate 92, the rear bottom hinge plate 94, the bottom surface 74, the front bottom hinge plate 96, the front top hinge plate 98 and returning to the glue tab 90 to complete a six sided 30 collapsible box shape with an arched top surface 64. Pivotally connected to the top surface 64 is the top triple hinge plate 100 which is pivotally connected to the middle triple hinge plate 102 which is pivotally connected to a fold-out panel 76 to form a triple hinged deployable set of pivoting sheets of material that conform to the shape of the user's lap and chest, the panel 76 having three operating positions. Firstly, the fold-out panel 76 has a compact conformal wrap position that stays out of the way during transfer from the restaurant to the vehicle and provides a double layer spill barrier while in place. Secondly, the fold-out panel 76 pivots out to an angle that rests on the users chest and lap when the pop-up tray 2 is in the lap so that the fold-out panel 76 can shield the user's clothing from particles of food spilled while eating in a moving vehicle; and thirdly, the fold-out panel 76 folds to enclose the empty French fry container 52, empty drink cup 48 and other empty packaging for transport to a garbage can for disposal.

FIG. 5 illustrates the tray 2 in a compact, folded-down-configuration, typical of the condition this embodiment of the invention is in while being shipped to the restaurant in stacks of trays. FIG. 6 illustrates the automatic pop-out food tray support legs 10 being deployed as the box structure expands, curves and erects into a functional position. FIG. 7 shows the fully erected, functional position of the tray 2 with the legs 10 in the fully down and locked position to provide an elevated platform for the food on a table or a support that fits into the seat belt of a typical car seat for support and retention of the meal while eating in a moving vehicle. FIG. 7 also shows the tab 76T of the panel 76 engaging the slot 76S that is formed in the bottom surface 74 for holding the panel against the bottom surface 74

FIGS. 8, 9 and 10 illustrate the top triple hinge plate 100, the middle triple hinge plate 102 and the fold-out panel 76 that catches spilled food particles while eating seated in a moving vehicle, being folded out from its stored conformal position under the tray.

FIGS. 11, 12 and 13 show the top triple hinge plate 100, the middle triple hinge plate 102 and the fold-out panel 76 that also functions as a fold over cover that contains the used wrapping paper of the sandwich 46, crushed drink cup 48, cup lid 50, folded French fry container 52, crushed dessert container 60, straw 54, used condiment packs 58, used utensils 56 and used napkins in a neat, organized package for convenient disposal with FIG. 13 showing the tab 76 engaging the slot 26 to hold the panel 76 closed over the used food items.

FIG. 14 shows one embodiment of the current invention in the form of a die cut pattern for the food tray showing the multiple spring cam mechanism 4 for accommodating a wide variety of drink cup sizes the fold-out panel 76 that catches spilled food particles while eating seated in a moving vehicle, the foldable condiment serving tub 80, the fold-out panel 76 that contains the used food containers for convenient disposal, the punch out game pieces 40 and 42, the random number spinning device 38 and the automatic pop-out food tray support legs 10.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. A pop-up tray comprising a tubular structure including top, bottom, front and back wall portions having hinged connections therebetween, and a pair of leg walls having hinged connections to the tubular structure at opposite ends thereof, the tray having a storage condition wherein the top and bottom wall portions are in facing contact and the front and back wall portions and the leg walls are disposed parallel to the top and bottom walls, and a deployed condition wherein the top and bottom wall portions are stiffly spaced apart and the leg walls stiffly project below the bottom wall portion, the top wall portion having openings formed therein for receiving objects to be held by the tray, wherein the leg walls each have hingedly connected upper and lower segments, the lower segment being hingedly connected at an intermediate location to the bottom wall portion, the upper and lower segments having facing contact in the storage condition.

2. The pop-up tray of claim 1, wherein the front and back wall portions each have hingedly connected upper and lower sections, the upper and lower sections having facing contact in the storage condition.

3. The pop-up tray of claim 1, wherein the upper segment of each of the leg walls is hingedly connected along a leg hinge axis to the top wall portion, the leg hinge axes having respective non-linear shapes for detenting the tray into the deployed condition.

4. The pop-up tray of claim 3, wherein the leg hinge axes are curved, being concave outwardly along opposite ends of the top wall portion for forming the top wall portion upwardly convex in the deployed condition of the tray.

5. A method for serving fast food items for consumption thereof, comprising:

(a) providing the pop-up tray of claim 3 in the storage condition thereof;

(b) applying downward and oppositely outward forces to free end extremities of the leg walls while simultaneously applying opposite inward forces to upper portions of the leg walls, thereby popping the tray into the deployed condition;

(c) inserting the fast food items into respective ones of the top wall openings.

6. The pop-up tray of claim 1, wherein the lower segments of the leg walls are reinforced for limiting bending thereof.

7. The pop-up tray of claim 6, wherein the tubular structure and the leg walls are integrally formed of a single sheet of card stock.

8. The pop-up tray of claim 1, wherein the top wall portion is formed having a circular array of spring cam elements for gripping a beverage cup when the beverage cup is inserted within the array.

9. A pop-up tray comprising a tubular structure including top, bottom, front and back wall portions having hinged connections therebetween, and a pair of leg walls having hinged connections to the tubular structure at opposite ends thereof, the tray having a storage condition wherein the top and bottom wall portions are in facing contact and the front and back wall portions and the leg walls are disposed parallel to the top and bottom walls, and a deployed condition wherein the top and bottom wall portions are stiffly spaced apart and the leg walls stiffly project below the bottom wall portion, the top wall portion having openings formed therein for receiving objects to be held by the tray, the top wall portion is formed having a circular array of spring cam elements for gripping a beverage cup when the beverage cup is inserted within the array, wherein the spring cam elements are coplanar with the top wall portion in the storage condition, the cam elements being formed for contacting the beverage cup at a first plurality of locations proximate the bottom wall portion, and at a second plurality of locations being located above the first plurality of locations, with the cup resting on the bottom wall portion.

10. The pop-up tray of claim 8, wherein the spring cam elements are formed for making gripping contact with cups having a 2 to 1 range of cup diameters at respective contact locations of the spring cam elements.

11. The pop-up tray of claim 1, wherein the openings of the top wall include a main opening for receiving a main object, the tubular structure further comprising a plurality of container wall portions hingedly connected to top wall portion and extending within the main opening, free extremities of the container wall portions being formed for interlocking engagement between the top wall portion and the bottom wall portion when the tray is in the deployed condition.

12. The pop-up tray of claim 11, wherein the top wall portion is upwardly convex in the deployed condition of the tray, the container wall portions including a pair of longitudinally spaced side wall portions, the side wall portions being hingedly joined to the top wall portion along corresponding side hinge axes, the side hinge axes being curved inwardly concave for reinforcing the upwardly convex formation of the top wall portion and the interlocking engagement of the container wall portions.

13. The pop-up tray of claim 8, wherein the spring cam elements are integrally formed with the top wall portion.

14. A pop-up tray comprising a tubular structure including top, bottom, front and back wall portions having hinged connections therebetween, and a pair of leg walls having hinged connections to the tubular structure at opposite ends thereof, the tray having a storage condition wherein the top and bottom wall portions are in facing contact and the front and back wall portions and the leg walls are disposed parallel to the top and bottom walls, and a deployed condition wherein the top and bottom wall portions are stiffly spaced apart and the leg walls stiffly project below the bottom wall portion, the top wall portion having openings formed therein for receiving objects to be held by the tray, further comprising a tray panel having a hinged connection to the tubular structure, the tray panel having a storage position in facing contact with the bottom wall portion in the storage and deployed conditions of the tubular structure, a deployed position projecting outwardly from the tubular structure, and a closed position in facing contact with a portion of the top wall portion for covering at least one of the openings thereof.

15. The pop-up tray of claim 14, wherein the openings of the top wall portion include a main opening for receiving a main object, and a secondary opening for receiving a projecting secondary object, the tray panel in the closed position thereof covering the main opening and clearing the secondary opening.

16. The pop-up tray of claim 14, wherein a free extremity of the tray panel is formed for tab-engagement with the top wall portion for holding the tray panel in the closed position.

17. The pop-up tray of claim 14, wherein the tray panel has a main portion and a root portion hingedly connecting the main portion to the tubular structure proximate an upper extremity of the front wall portion, the main and root portions being hingedly connected, the root portion being in facing contact with the front wall portion in the storage position.

18. The pop-up tray of claim 14, wherein the tubular structure, the leg walls, and the tray panel are integrally formed of a single sheet of card stock, substantially every wall portion and every wall segment being subjected to one or more of bending, twisting, arching, stretching and compressing in the deployed condition for enhanced rigidity of the tray in use.

19. The pop-up tray of claim 18, wherein the leg walls are perforated for forming finger openings by removal of portions of the card stock, portions of the card stock to be removed having indicia thereon for forming game tokens, the top wall portion having token openings for holding the game tokens, the tray panel having indicia thereon for defining a game playing surface.

20. A pop-up tray comprising a tubular structure including top, bottom, front and back wall portions having hinged connections therebetween, and a pair of leg walls having hinged connections to the tubular structure at opposite ends thereof, the tray having a storage condition wherein the top and bottom wall portions are in facing contact and the front and back wall portions and the leg walls are disposed parallel to the top and bottom wall portions, and a deployed condition wherein the top and bottom wall portions are stiffly spaced apart and the leg walls stiffly project below the bottom wall portion, the top wall portion having openings formed therein for receiving objects to be held by the tray, wherein the tray further comprises a foldable tub member for engaging one of the top wall openings, the tub member being formed from material of the top wall portion within another of the top wall openings.

21. A pop-up tray comprising a tubular structure including top, bottom, front and back wall portions having hinged connections therebetween, and a pair of end walls having hinged connections to the top wall portion of the tubular structure at longitudinally spaced locations thereon, the tray having a storage condition wherein the top and bottom wall portions are in facing contact and the front and back wall portions and the end walls are disposed parallel to the top and bottom walls, and a deployed condition wherein the top and bottom walls are stiffly spaced apart, the top wall being stiffly maintained in a curved condition in the deployed condition with the end walls having interlocking engagement with the bottom wall portion, the top wall portion also having at least one opening formed therein for receiving an object to be held by the tray.

22. The pop-up tray of claim 21, wherein the front and back wall portions each have hingedly connected upper and lower sections, the upper and lower sections having facing contact in the storage condition.

23. The pop-up tray of claim 21, wherein the end walls each have hingedly connected upper and lower segments, the lower segment being hingedly connected at an intermediate location to the bottom wall portion, the upper and lower segments having facing contact in the storage condition.

24. The pop-up tray of claim 23, wherein the upper section of each of the end walls is hingedly connected along an end hinge axis to the top wall portion, the end hinge axes having respective non-linear shapes for detenting the tray into the deployed condition.

25. The pop-up tray of claim 24, wherein the end hinge axes are curved, being concave outwardly along opposite ends of the top wall portion for forming the top wall portion upwardly convex in the deployed condition of the tray.

26. A pop-up tray having a flattened storage condition and a deployed condition for holding fast food items including a beverage cup, a main course, a side dish container, and a fluidic condiment, the tray comprising:

(a) a tubular structure including top, bottom, front and back wall portions having hinged connections therebetween, the front and back wall portions each having hingedly connected upper and lower sections, the upper and lower sections having proximal facing contact in the storage condition, the top wall portion being formed having:

(i) a main opening for receiving the main course, the tubular structure further comprising a plurality of container wall portions hingedly connected to top wall portion and extending within the main opening, free extremities of the container wall portions being formed for interlocking engagement between the top wall portion and the bottom wall portion when the tray is in the deployed condition for supportively containing the main course;

(ii) a secondary opening for receiving the side dish container in projecting relation to the top wall portion; and (iii) a circular array of spring cam elements for gripping a beverage cup when the beverage cup is inserted within the array, the spring cam elements being integrally formed and coplanar with the top wall portion in the storage condition, the cam elements being formed for contacting the beverage cup at a first plurality of locations proximate the base thereof, and at a second plurality of locations being elevated above the first plurality of locations, with the cup resting on the bottom wall portion and projecting above the top wall portion in the deployed condition;

(b) a pair of leg walls having hinged connections to the tubular structure at opposite ends thereof, the leg walls each have hingedly connected upper and lower segments, the lower segment being hingedly connected at an intermediate location to the bottom wall portion, the upper and lower segments having facing contact in the storage condition, the upper section of each of the leg walls being hingedly connected along a leg hinge axis to the top wall portion, the leg hinge axes being curved concave outwardly along opposite ends of the top wall portion for detenting the tray into the deployed condition with the top wall portion formed upwardly convex, the lower segments of the leg walls being reinforced for limiting bending thereof; and (c) a tray panel having a hinged connection to the tubular structure, the tray panel having a storage position in facing contact with the bottom wall portion in the storage and deployed conditions of the tubular structure, a deployed position projecting from the tubular structure, and a closed position in facing contact with the top wall portion for covering the main opening thereof, wherein the tubular structure, the tray panel, and the leg walls are integrally formed of a single sheet of card stock.

27. The pop-up tray of claim 26, wherein the openings of the top wall portion further include a tertiary opening, the tray further comprising a foldable tub member for engaging the tertiary opening and holding the condiment, the tub member being formed from material of the top wall portion within the secondary opening.

28. A method for forming a pop-up tray, comprising:

(a) providing a sheet of stiffly flexible material;

(b) forming a perimeter contour of the sheet to define:

(i) adjacent top, bottom, front and back wall portions, and a tab wall portion, of a tubular structure, the front and back wall portions each having upper and lower wall portion segments;

(ii) respective outer leg wall portions adjacent opposite ends of the top wall portion; and (iii) respective inner leg wall portions adjacent opposite ends of the bottom wall portion, each of the inner and outer leg wall portions having upper and extremity segments, the extremity segments being longer than the upper segments;

(c) forming hinge discontinuities between adjacent pairs of the wall portions, along opposite ends of the top and bottom wall portions, between the upper and lower wall portion segments, and between the upper and extremity leg wall segments;

(d) forming at least one opening in the top wall portion;

(e) bonding the tab wall portion to another of the wall portions along a most remote opposite wall portion extremity of the sheet to form the tubular structure;

(f) flattening the tubular structure with the upper and lower wall portion segments in facing relation and the top and bottom wall portions in proximal facing relation;

(g) folding the inside leg wall portions between the upper and extremity segments thereof into facing relation with the extremity segments facing the bottom wall portion opposite the top wall portion;

(h) folding the outside leg wall portions between the upper and extremity segments thereof into facing relation with the extremity segments facing corresponding extremity segments of the inside leg wall portions; and (i) bonding respective ones of the inner and outer leg wall portion extremity segments in facing relation, thereby completing the tray in the flattened storage condition with the top and bottom wall portions in proximal facing contact, the deployed condition being attained by subsequently pivoting the leg wall extremity segments downwardly and outwardly to rigidly space apart the top and bottom wall portions as the upper segments of the leg walls pivot downwardly and inwardly relative to the top wall portion into an over-center condition relative to the extremity segments.

29. The method of claim 28, wherein forming the perimeter contour further comprises defining a tray panel portion adjacent the front wall portion, the forming of hinge discontinuities further includes a longitudinal discontinuity between the tray panel portion and the front wall portion, and the bonding of the tab wall portion is to the front wall portion proximate the tray panel, the method further comprising folding the tray panel portion into proximal facing relation with the front and bottom wall portions.

30. The method of claim 28, wherein forming the perimeter contour further comprises defining respective outwardly concave leg hinge axes between the upper segments of the outer leg walls and the top wall portion whereby the top wall portion is upwardly convex in the deployed condition.

31. The pop-up tray of claim 9, wherein the spring cam elements are integrally formed with the top wall portion.

32. The pop-up tray of claim 9, wherein the spring cam elements are formed for making gripping contact with cups having a 2 to 1 range of cup diameters at respective contact locations of the spring cam elements.

* * * * *